United States Patent [19]

Krakauer

[11] Patent Number: 4,842,161

[45] Date of Patent: Jun. 27, 1989

[54] COUNTERTOP SNACK VENDOR

[75] Inventor: Merrill Krakauer, Short Hills, N.J.

[73] Assignee: Rowe International, Inc., Whippany, N.J.

[21] Appl. No.: 58,611

[22] Filed: Jun. 4, 1987

Related U.S. Application Data

[63] Continuation of Ser. No. 762,938, Aug. 6, 1985, abandoned.

[51] Int. Cl.[4] ..... G07F 11/52

[52] U.S. Cl. ..... 221/76; 221/120; 221/122; 221/151; 221/155; 221/154; 312/305

[58] Field of Search ..... 221/76, 82, 83, 86, 221/87, 113, 119, 120, 121, 122, 126, 129, 133, 151, 152, 153, 154, 155; 312/97.1, 35, 305; 194/350

[56] References Cited

U.S. PATENT DOCUMENTS

| | | | |
|---|---|---|---|
| 767,121 | 8/1904 | Priebe | 221/113 |
| 1,025,235 | 5/1912 | Beal et al. | 221/82 X |
| 1,025,286 | 5/1912 | Marshall | 221/83 |
| 1,397,615 | 11/1921 | Bassett | 221/155 X |
| 1,715,726 | 6/1929 | Tomoda | 221/83 |
| 1,754,487 | 4/1930 | Schweitzer | 221/76 X |
| 1,840,851 | 1/1932 | Schmelz | 221/82 |
| 1,913,917 | 6/1933 | Crowe | 221/82 |
| 2,766,905 | 10/1956 | Heinig | 221/83 |
| 2,811,403 | 10/1957 | Barker et al. | 194/240 X |
| 4,049,154 | 9/1977 | Burks | 221/76 |
| 4,236,649 | 12/1980 | Fellner et al. | 221/155 X |
| 4,317,604 | 3/1982 | Krakauer | 312/97.1 |
| 4,391,388 | 7/1983 | Krakauer | 221/76 |
| 4,498,603 | 2/1985 | Wittenborg | 221/155 X |

FOREIGN PATENT DOCUMENTS

| | | | |
|---|---|---|---|
| 2104050 | 3/1983 | United Kingdom | 221/120 |

*Primary Examiner*—Joseph J. Rolla
*Assistant Examiner*—Edward S. Ammeen
*Attorney, Agent, or Firm*—Shennier & O'Connor

[57] ABSTRACT

A countertop snack vendor in which a drum having a plurality of groups of circumferentially spaced article-receiving compartments is mounted within a cabinet for rotary movement around a generally horizontal axis with the groups disposed respectively behind normally locked elongated transparent doors, each of which spans a plurality of compartments of its associated group to afford a potential customer a view of a large number of articles. Each door is freed upon the deposit of money in the vendor for limited movement from a normally closed position to an open position at which a single compartment of the associated group is accessible.

20 Claims, 4 Drawing Sheets

COUNTERTOP SNACK VENDOR

This is a continuation of co-pending application Ser. No. 762,938, filed on Aug. 6, 1985, now abandoned.

FIELD OF THE INVENTION

My invention relates to the field of merchandising machines and more particularly to a countertop snack vendor.

BACKGROUND OF THE INVENTION

Various types of merchandising machines are known in the prior art for dispensing a variety of snacks. Most of these are relatively large, free-standing machines which are relatively expensive. They have a large capacity so as to be particulary adapted for installation at locations at which the volume of sales can be expected to be relatively large. Many of these machines provide the prospective customer with a view of a large number of articles from which he may make a selection. In general these machines are not suitable for locations at which space is at a premium and whereat the expected volume of sales is relatively low. Neither are they suitable for locations whereat inexperienced persons are to load the machine from bulk supplies rather than being loaded by experienced route men.

SUMMARY OF THE INVENTION

One object of my invention is to provide a countertop snack vendor which is especially adapted for installation at a location whereat space is at a premium.

Another object of my invention is to provide a countertop snack vendor which is especially adapted for installation at a location whereat the expected volume of sales is relatively small.

A further object of my invention is to provide a countertop snack vendor which affords a potential customer with a view of a relatively large percentage of the articles contained in the vendor without operating the machine.

Still another object of my invention is to provide a countertop snack vendor which is easy to load.

An additional object of my invention is to provide a countertop snack vendor which sells a large variety of products.

Yet another object of my invention is to provide a countertop snack vendor which is relatively simple in construction and in operation.

A still further object of my invention is to provide a countertop snack vendor which is relatively inexpensive as compared with large free-standing merchandising machines.

Other and further objects of my invention will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1:
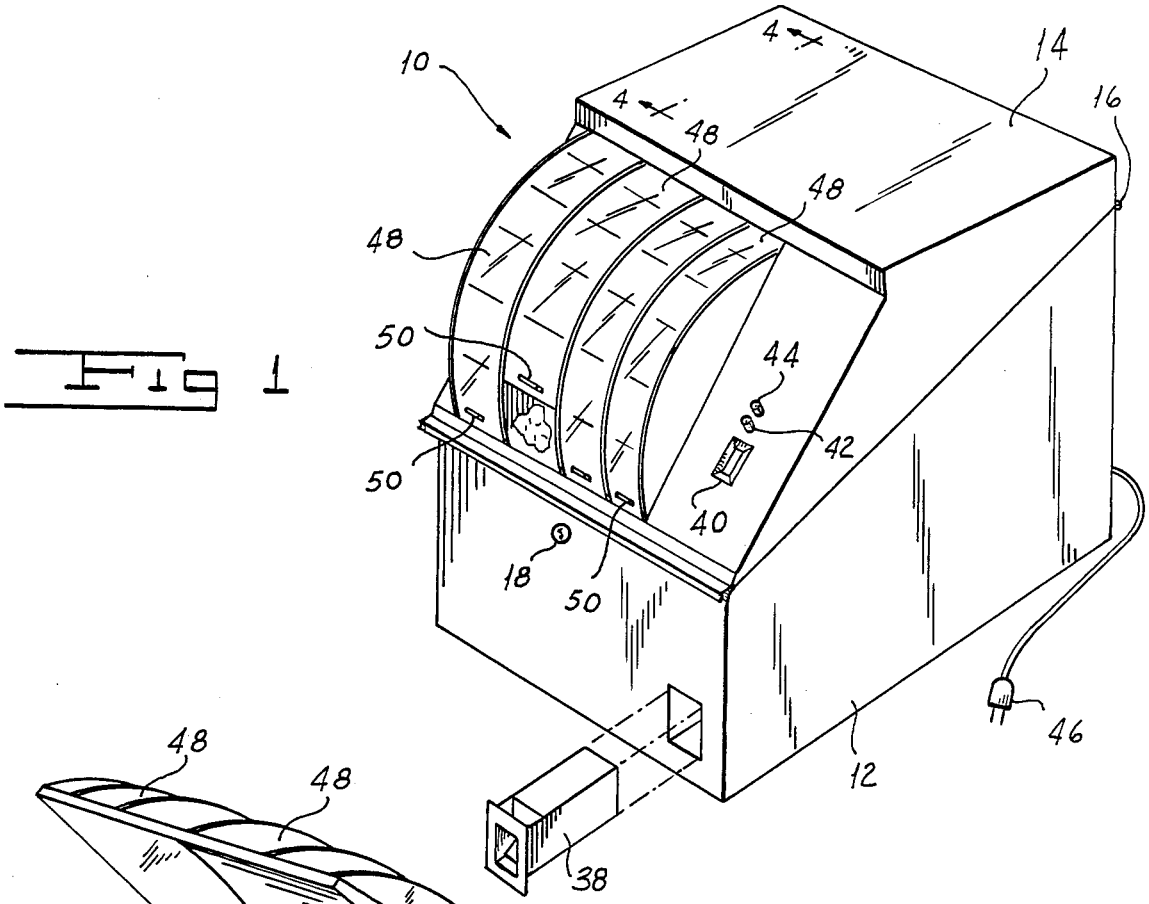
FIG. 1 is a perspective view of my countertop snack vendor with the lid closed and with the cash box withdrawn.
Figure 2:
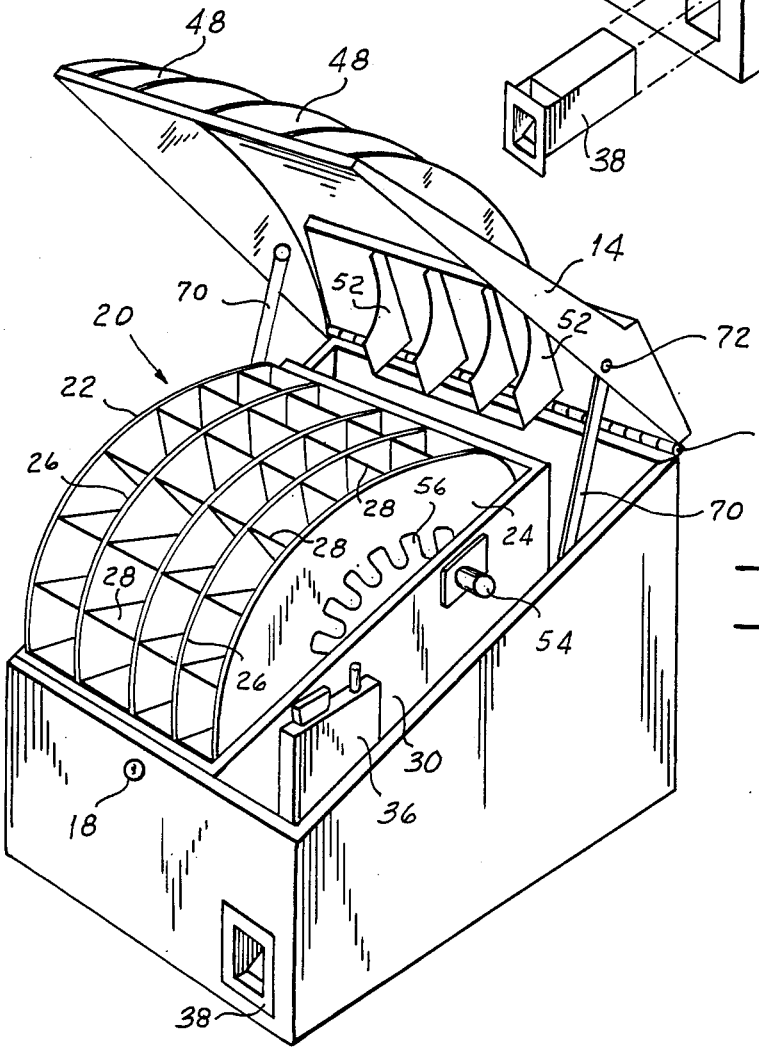
FIG. 2 is a perspective view of my countertop snack vendor with the lid raised and with parts removed.
Figure 3:
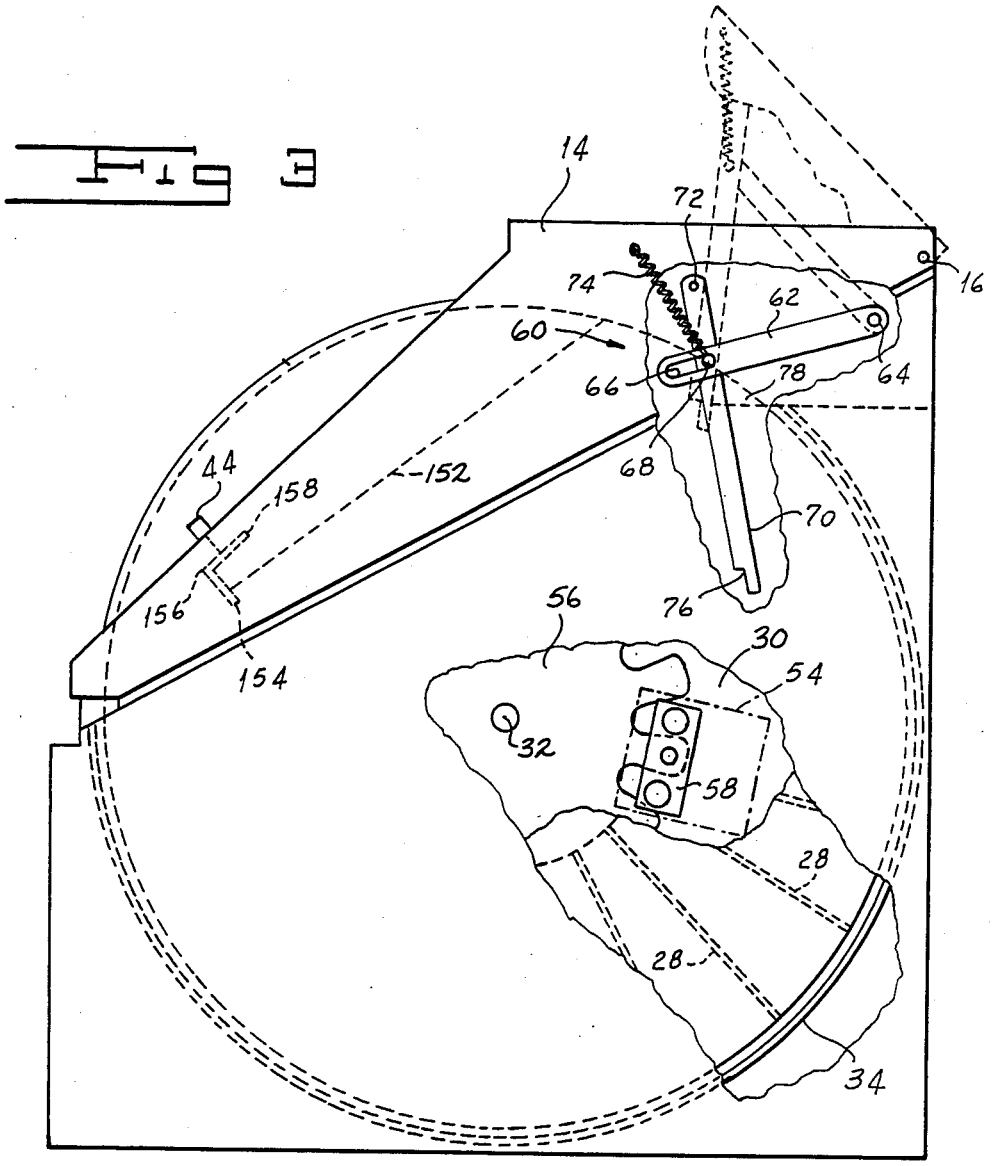
FIG. 3 is a side elevation of my countertop snack vendor with parts broken away.
Figure 7:
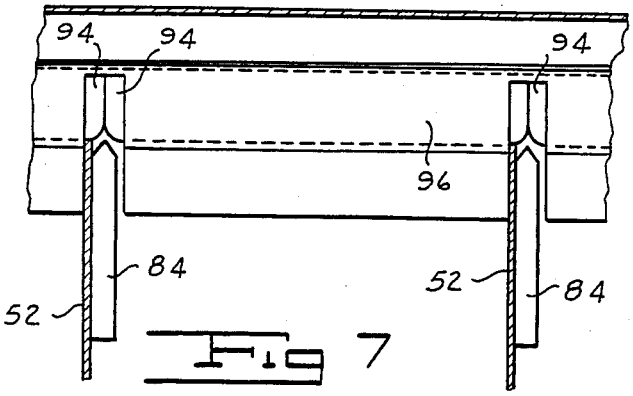
FIG. 7 is a fragmentary sectional view of my countertop snack vendor taken along the line 7—7 of FIG. 4.

Referring now to FIGS. 1 to 3 of the drawings my countertop snack vendor indicated generally by the reference character 10 includes a cabinet 12 provided with a lid 14 supported on the cabinet 12 by means of a hinge 16 for movement between an open position at which the machine can be loaded in a matter to be described and a closed position. A lock 18 may be provided to secure the lid in its closed position.

Cabinet 12 houses a drum indicated generally by the reference character 20 having end plates 22 and 24 and a number of partitions 26 at spaced locations between the end plates 22 and 24. A plurality of radially extending dividers 28 separate the drum into a plurality of merchandise receiving compartments. A sub-housing or receptacle 30 within the cabinet 12 rotatably supports the shaft 32 of the drum 20. This sub-housing 30 includes an arcuate shroud 34 in sufficiently closely spaced relationship to the outer periphery of the drum and over a sufficient portion of the periphery to prevent articles from sliding out of the drum compartments under the influence of gravity.

A space between one side of the sub-housing 30 and a sidewall of the cabinet 12 supports the coin mechanism 36 as well as a coin and slug box 38. A coin slot 40 in a downwardly inclined front portion of the lid 14 guides coins into the coin mechanism 36. A first push button 42 in this part of the lid just above the coin slot 40 can be actuated to return bent coins to the customer in the event one is caught in the coin mechanism. A second push button 44 arranged in the lid above the push button 42 is adapted to be actuated in a manner to be described to cause the drum 20 to rotate so that all of the articles in the drum can be viewed by a potential customer. An electrical plug 46 is adapted to be inserted in any suitable receptacle to provide the vendor 10 with electrical power.

From the structure thus far described it will be apparent that the drum 20 occupies a portion of the space within cabinet 12 at one side of the space below the downwardly inclined lid portion. I provide the portion of the lid to the left of the downwardly inclined front lid portion with means for slideably supporting a plurality of curved transparent doors corresponding in number to the number of groups of circumferentially arranged merchandise containing compartments in the drum. Moreover, each of the sliding doors 48 has a width which corresponds to the width of the compartments of the group of drum compartments associated therewith. Each door 48 is provided with a handle 50 by means of which the door can be moved upwardly along an arcuate path in a manner to be described more fully herein below. The underside of a generally horizontal portion of the lid 14 behind doors 48 carries a plurality of spaced control mechanisms supporting plates 52 corresponding in number to the number of groups of merchandise containing compartments in the drum.

A drive motor 54 supported on the outside of one of the sidewalls of the subhousing 30 is adapted to be energized to step the drum 20 in a number of steps equal to the number of merchandise containing compartments in each group, which is the particular form of the invention shown is 24. More specifically shaft 32 carries a Geneva wheel 56 adapted to be driven by a driver 58 on the output shaft of the motor 54. As is known in the art in such a drive the driven member which in this case is the drum 20 is stepped in a number of equal steps and so as to be relatively precisely positioned at the end of each step.

I provide the lid 14 with a latching mechanism indicated generally by the reference character 60 which releasably holds the lid in its open position for loading. A pair of arms 62 at each side of the machine are pivotably supported on pins 64 on the cabinet 12. Each arm 62 has a slot 66 which receives a pin 68 carried by a lid-supporting strut 70 pivoted on a pin 72 in the lid 14. An over center spring 74 is connected between pin 68 and the lid 14. When the lid is raised to its open position strut 70 moves to a position at which a notch 76 therein engages a bracket 78 in the cabinet 12 so as to hold the lid in its raised position. To lower the lid it is first raised beyond its open position to cause the over-center spring 74 to move the struts 70 out of engagement with the bracket 78 so that the lid may then be lowered to its closed position.

Figure 4:
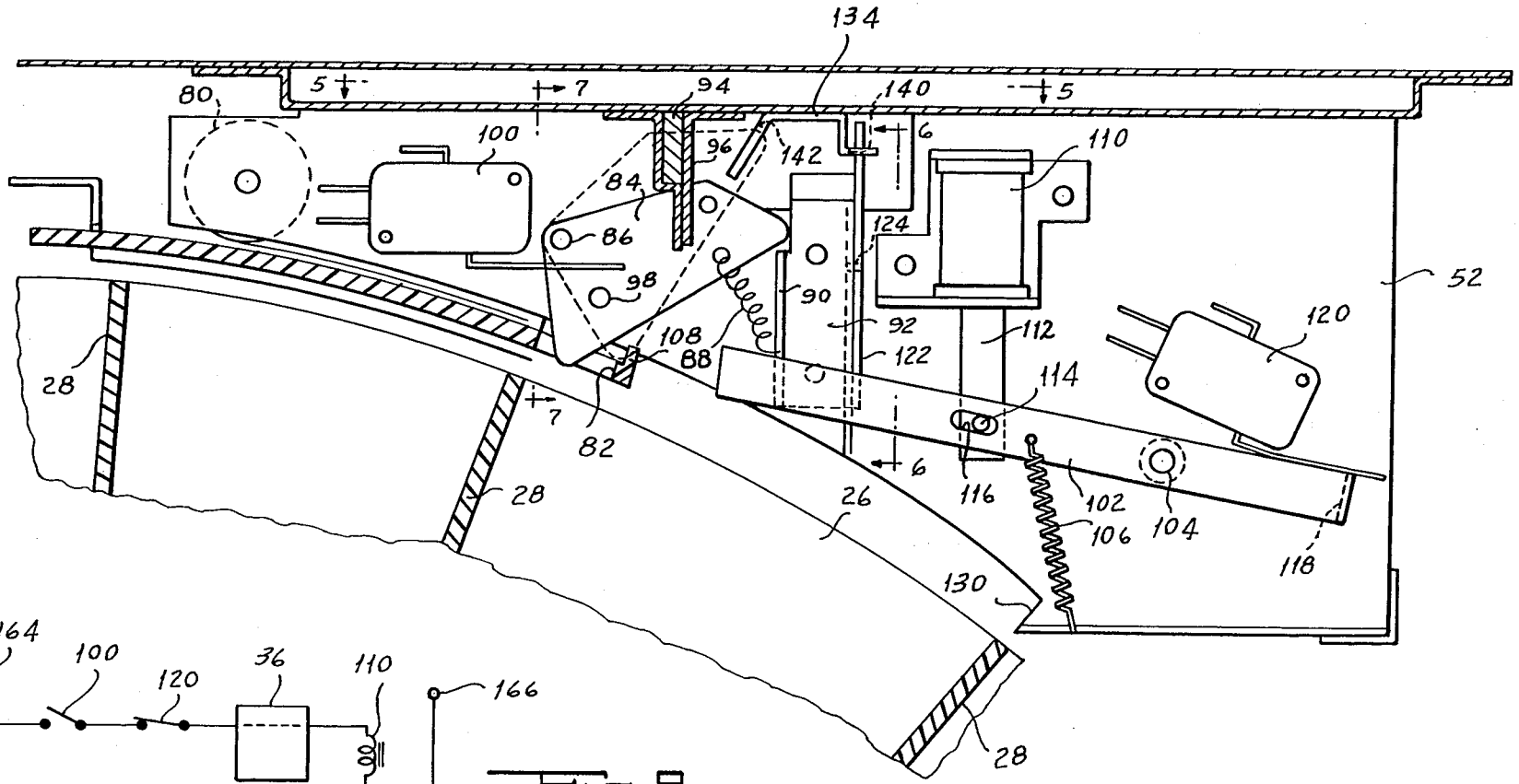
FIG. 4 is a fragmentary section of my countertop snack vendor taken along the line 4—4 of FIG. 1.

Referring now to FIG. 4, a respective negator spring 80 secured on a bracket 52 is associated with each door 48 so as normally to urge the door to its closed position at which access to a compartment of the associated set of drum compartments is not possible. In order to move the door 48 to its open position the handle 50 is grasped and moved upwardly so as to raise the door. This results in a movement of the upper end of the door to the right as viewed in FIG. 4. Each door 48 has a slot 82 adjacent to its upper end for receiving one lobe of an actuator 84 mounted for pivotal movement on a pin 86 supported on the bracket 52. A spring 88 urges the actuator 84 to a position at which it abuts a stop 90 on a bracket 92 secured to the plate 52. A plurality of locking slides 94 are supported in a housing 96. When a door 48 is opened the actuator 84 tends to move upwardly between a pair of adjacent slides 94 in a matter known to the art. As will be more fully described hereinbelow, this arrangement prevents more than a single door from being opened at the same time.

As the actuator 84 rotates in a counterclockwise direction when its associated door is opened a pin 98 on the actuator operates a switch 100.

The operating mechanism associated with each of the doors 48 includes a lock bar 102 pivotally supported on a pin 104 carried by plate 52. A spring 106 normally urges the lock bar 102 to rotate in a counterclockwise direction as is viewed in FIG. 4. When the bar 102 is in the position shown, it limits the opening movement of the corresponding door 48 by virtue of the engagement of a foot 108 with the end of the bar 102.

A solenoid 110 carried by the plate 52 has an armature 112 carrying the pin 114 which is received in a slot 116 in the bar 102. Solenoid 110 is energized by the closing of switch 100 when sufficient money has been deposited in the machine. Energization of the solenoid moves the lock bar 102 to a position at which the left end as viewed in FIG. 4 is out of the path of movement of the foot 108 so the door can be moved to its fully opened position. At the same time a flange 118 on the other end of the bar 102 releases the actuating element of a switch 120 to permit the switch to open to deenergize the solenoid in a matter to be described herein below.

A lock bar latch 122 is pivotably supported on a pin 124 on the bracket 92. A spring 126 normally urges the latch 122 to the full-line position shown in FIG. 6. When the lock bar pivots to door-releasing position under the action of solenoid 110, the nose 128 of the latch 122 snaps under the bar 102 to hold it in its door-released position.

I form the plate 52 with a door limit stop 130 adapted to be engaged by the foot 108 when the door 48 has been moved to its fully open position.

Figure 6:
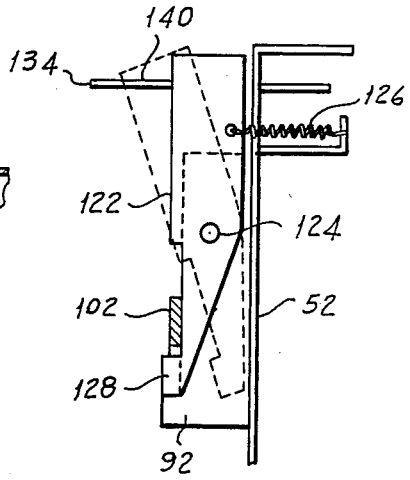
FIG. 6 is a fragmentary sectional view of my countertop snack vendor taken along the line 6—6 of FIG. 4.
Figure 5:
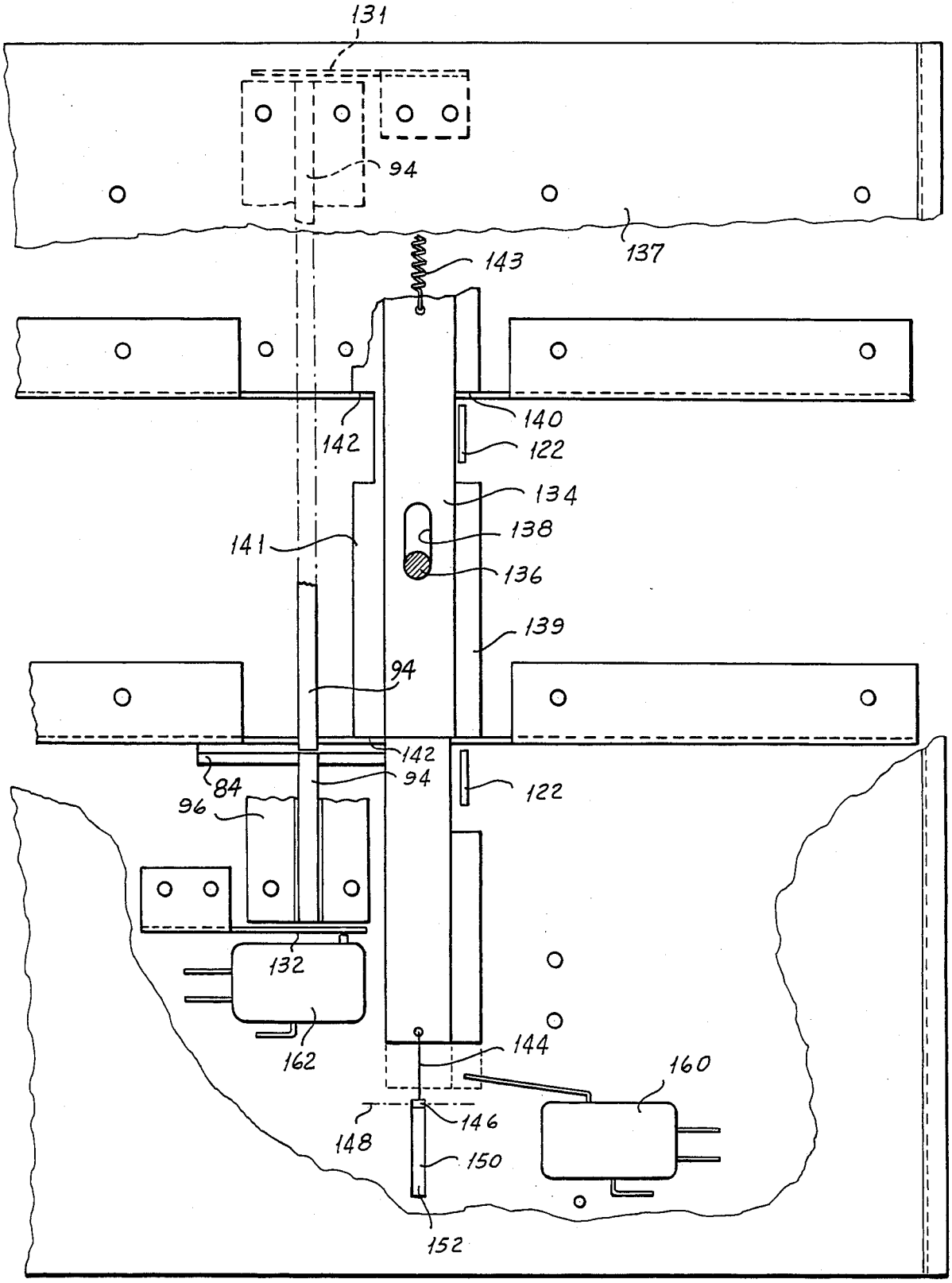
FIG. 5 is a fragmentary top plan of my countertop snack vendor with parts removed and with other parts broken away taken along the line 5—5 of FIG. 4.

Referring now to FIGS. 4 to 6, the locking slides 94 are urged to their normal positions which they occupy in the absence of any actuator 84 between a pair of adjacent slides by a pair of leaf springs 131 and 132. When any actuator 84 has been moved into the space between a pair of adjacent slides 94 the other slides are so positioned as to prevent a corresponding movement of any other actuator.

My machine includes a reset bar 134 slideably mounted on pins 136 on a plate 137 by means of slots 138. I form an offset flange 139 on bar 134 with a plurality of spaced shoulders 140 past which the upper ends of the pawls 122 extend. When the bar 134 moves downwardly as viewed in FIG. 5 in a manner to be described, the shoulders 140 engage the latches 122 to pivot them in a counterclockwise direction, as viewed in FIG. 6, to release any lock bar 102 which has been latched.

A downwardly extending flange 141 on the other side of the lock bar 134 from the flange 139 is formed with a plurality of shoulders 142. When any actuator 84 is latched in its door-open position, any attempt to move the reset slide 134 downwardly as viewed in FIG. 5 will be prevented by the engagement of a shoulder 142 with the raised actuator 84.

Referring now to FIGS. 3 and 5, I may employ a spring 143 to urge the bar 134 to the full-line position shown in FIG. 5. A length of wire or cord 144 connects reset bar 134 to an upwardly extending arm 146 of the bellcrank supported for pivotal movement around an axis 148. I connect the other arm 150 of this bellcrank to a downwardly extending arm 154 of a second bellcrank by means of a wire or cord 152. The second bellcrank is mounted for movement around a pin 156. The other arm 158 of the second bellcrank is adapted to be actuated when button 44 is pressed.

When the reset bar 134 moves to the broken line position illustrated in FIG. 5, it closes a normally open switch 160. When the locking slides are displaced from their normal positions by the presence of an actuator 84 between a pair of adjacent slides, spring arm 132 opens a normally closed switch 162.

Figure 8:
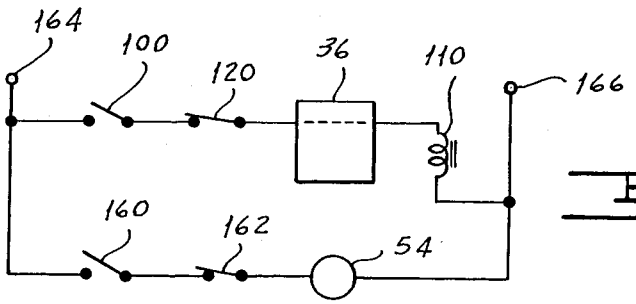
FIG. 8 is a schematic view illustrating one form of electrical control circuit which may be employed with my countertop snack vendor.

Referring now to FIG. 8, I connect switch 100 switch 120, solenoid 110 and the coin mechanism 36 in series between the terminals 164 and 166 of the power supply of our machine. Similiarly I connect switches 160 and 162 in series with transport motor 54 between the terminals 164 and 166.

In operation of our machine a potential customer approaching the machine pushes the transport button 44 to move reset bar 134 downwardly as viewed in FIG. 5 to move all of the locking pawls 122 to positions in which they release their corresponding lock bars 102 to permit them to move to door-blocking positions. It is to be noted that my machine includes a mechanical and a electrical safety. If an actuator 84 is in position between a pair of locking slides 94, then the reset bar can not be moved downwardly as viewed in FIG. 5. At the same time displacement of a locking slide operates switch 162 to prevent the transport motor from being energized. Assuming that all of the doors 48 have been moved to their closed positions so that no member 84 is between a pair of slides 94, the reset bar 134 will move downwardly in the manner described to release all of the bars 102 and to operate switch 160 to start the transport motor 54.

The transport motor continues to run until the customer releases the button, at which time the Geneva drive will precisely position the drum 20 so that the compartment containing the desired article is in a position at which it can be removed when the associated door is moved to fully open position.

First, the customer positions the compartment containing the desired article behind its associated door. When that has been done, he grasps the handle 50 of the door in front of the desired article and moves the door upwardly. In response to this movement of the door, the actuator 84 moves up into position between a pair of adjacent slides 94 to prevent more than a single door at a time from being opened. At the same time pin 98 operates switch 100 to complete a circuit to the solenoid 110 through the coin mechanism 36 and through the switch 120. Solenoid 110 then moves bar 102 to door-releasing position. Pawl 122 snaps under the bar to lock it into door-releasing position and switch 120 opens to deenergize the solenoid. The door can now be moved to fully opened position against the stop 130 and the article removed. The machine is now ready for the next operation.

It is to be noted that over a 90 degree sector of the drum 20 is visible through the doors 48 without transporting the drum so that a relatively large selection of articles is visible. In the particular embodiment shown, this means that a potential customer can view six compartments of any group or 24 compartments overall. In addition to affording a view of a large number of compartments, the transparent doors admit sufficient light to the interior to afford a good view of the merchandise without the necessity of any interior lighting.

To load the drum 20, the lock 18 is released and the lid is raised until the notches 76 and the struts 70 engage bracket 78. The drum can then be loaded with relative ease. When the loading operation is complete, the lid is merely raised a little further to cause the over-center spring 74 to release the strut 70 to permit the lid to be lowered.

Owing to the fact that the machine operates in a shopper mode, a large variety of articles can be dispensed. All that is necessary is that all articles to be sold from one group of compartments sell at the same price.

It will be seen that I have accomplished the objects of our invention. I have provided a countertop vendor which is especially adapted for use in locations at which space is at a premium. My countertop vendor is adapted for use in locations where the anticipated demand is relatively small. My vendor is relatively simple in construction and in operation. It affords the customer a view of a relatively large selection of articles without actuating the machine. It is relatively inexpensive as compared with large freestanding vendors of the prior art. It is easy to load. It dispenses a wide variety of articles.

It will be understood that certain features and subcombinations are of utility and may be employed without reference to other features and subcombinations. This is contemplated by and is within the scope of my claims. It is further obvious that various changes may be made in details within the scope of our claims without departing from the spirit of my invention. It is, therefore, to be understood that my invention is not to be limited to the specific details shown and described.

Having thus described my invention, what I claim is:

1. A snack vendor including in combination, a cabinet comprising a body having a top and a front, a drum having a plurality of groups of circumferentially arranged compartments for receiving articles of merchandise to be dispensed, means mounting said drum in said cabinet for rotation around a generally horizontal axis to present a drum upper front quadrant extending over a plurality of compartments of each of said groups, an opening in said cabinet extending over said drum upper front quadrant from a first location in the front of the cabinet below the cabinet top and adjacent to the lower terminus of said drum upper front quadrant to a second location in the top of the cabinet spaced rearwardly of the cabinet front and adjacent to the upper terminus of said drum upper front quadrant, transparent means in said cabinet opening spanning said drum upper front quadrant so that a potential customer has a view of a plurality of articles in respective compartments and of the articles next to be dispensed, said transparent means comprising a plurality of transparent doors disposed in side-by-side relationship in registration respectively with said groups of compartments, means mounting said doors for movement from closed positions at which the lower edges thereof register with the edge of said front at the bottom of said opening to prevent access to the compartments of the associated group to open positions at which a compartment of the associated group is accessible, means for rotating said drum selectively to position said groups of compartments in registry with said doors, means normally locking said doors in their closed positions, money responsive means for releasing said doors, and means in the upper portion of said cabinet behind said second location and below said top for controlling the movement of said doors between said open and closed positions.

2. A snack vendor as in claim 1 including means for latching said locking means in disabled condition, and means for resetting said latching means.

3. A snack vendor as in claim 2 including means responsive to the presence of a door in open position for inhibiting the operation of said resetting means.

4. A snack vendor as in claim 2 including a transport motor and means responsive to the operation of said resetting means for energizing said transport motor.

5. A snack vendor as in claim 3 including means responsive to the presence of a door in open position for inhibiting the operation of a transport motor.

6. A snack vendor as in claim 2 including a transport motor, means responsive to operation of said resetting means for energizing said transport motor, means responsive to the presence of a door in open position for inhibiting the operation of said resetting means and second means responsive to the presence of a door in open position for inhibiting the operation of said energizing means.

7. A snack vendor as in claim 1 in which said drum has a generally cylindrical outline configuration, said body comprising a lid forming said top and said transparent means and means mounting said lid for movement between an open position and a closed position, said drum upper front quadrant projecting out of said opening in the closed position of said lid, said transparent means having a curved configuration conforming to the shape of said projecting portion of said drum.

8. A snack vendor as in claim 1 in which said cabinet is generally rectangular, said cabinet comprising a lid forming said body top and a downwardly and forwardly extending front portion comprising said transparent means, means mounting said lid for movement portion, a portion of said drum extending through the opening on closed position of said lid, said transparent means being curved to conform to the portion of said drum extending through said opening.

9. A snack vendor as in claim 1 in which said locking means comprises a plurality of lock bars associated respectively with said doors, means mounting each of said bars for movement between a locking position at which an end thereof prevents movement of the associated door to its open position and a released position at which the bar end permits movement of the associated door to open position, said money-responsive means selectively moving said locking bars to said released positions.

10. A snack vendor as in claim 9 in which said control means includes respective latches for holding bars which have been moved to released position, a reset slide, means mounting said reset slide for movement from a home position to an operative position at which it resets said latches, transport means adapted to be energized to rotate said drum around its axis, means including an externally accessible manually operable element on said cabinet adapted to be actuated to energize said transport means and a mechanical coupling between said manually operable element and said reset slide for moving said reset slide in response to operation of said element.

11. A snack vendor including in combination, a cabinet comprising a body having a top and a front, a drum having a plurality of groups of circumferentially arranged compartments for receiving articles of merchandise to be dispensed, means mounting said drum in said cabinet for rotation around a generally horizontal axis to present a drum upper front quadrant extending over a plurality of compartments of each of said groups, an opening in said cabinet extending over said drum upper front quadrant from a first location in the front of the cabinet below the cabinet top and adjacent to the lower terminus of said drum upper front quadrant to a second location in the top of the cabinet spaced rearwardly of the cabinet front and adjacent to the upper terminus of said drum upper front quadrant, a plurality of elongated transparent doors, means mounting said doors on said cabinet in side-by-side relationship over said opening and respectively registering with said groups of compartments, each of said doors spanning said drum upper front quadrant so that a potential customer has a view of articles in a plurality of compartments in each group and of the articles next to be dispensed, said mounting means mounting said doors for movement from closed positions at which the lower edges thereof register with the edge of said front at the bottom of said opening to prevent access to the compartments of the associated group to open positions at which a compartment of the associated group is accessible, means for rotating said drum selectively to position said groups of compartments in registry with said doors, means normally locking said doors in their closed positions, money responsive means for releasing said doors, and means in the upper portion of said cabinet behind said second location and below said top for controlling the movement of said doors to limit the open position to one at which only one compartment of the associated group is accessible.

12. A snack vendor as in claim 11 in which said control means includes respective locking means normally preventing movement of said doors to open position, and means including money responsive means for releasing said locking means.

13. A snack vendor as in claim 12 including means for latching a released locking means in released condition.

14. A snack vendor as in claim 13 including actuatable means for rotating said drum, and means responsive to said actuatable means for disabling said latching means.

15. A snack vendor as in claim 11 in which said doors are arcuate in a direction along the lengths thereof.

16. A snack vendor as in claim 11 in which each of said doors has an end extending beyond said second location, said locking means comprising a plurality of lock bars associated respectively with said doors, means mounting each of said bars for movement between a locking position at which an end is in the path of movement of the associated door end to its open position and a released position at which the bar end permits movement of the associated door to open position, said money-responsive means selectively moving said locking bars to said released positions.

17. A snack vendor as in claim 16 in which said control means includes respective latches for holding bars which have been moved to released position, a reset slide, means mounting said reset slide for movement from a home position to an operative position at which it resets said latches said drum rotating means comprising transport means adapted to be energized to rotate mechanical coupling between said manually operable element and said reset slide for moving said reset slide in response to operation of said element.

18. A snack vendor including in combination a cabinet comprising a body and a plurality of doors, a drum having a plurality of groups of circumferentially arranged compartments for receiving articles of merchandise to be dispensed, means mounting said drum in said cabinet for rotation around a generally horizontal axis to present a drum upper front quadrant, said cabinet having transparent means comprising said doors disposed in front of said drum upper front quadrant, said transparent means extending from a first location in the front of the cabinet below the cabinet top and adjacent to the lower terminus of said drum upper front quadrant to a second location in the top of the cabinet spaced rearwardly of the cabinet front and adjacent to the upper terminus of said drum upper front quadrant for affording a potential customer a view of a plurality of compartments of each group and of the article next to be dispensed from each group, means for rotating said drum selectively to position said groups of compartments in register with said doors, means mounting said doors on said front in association with the respective groups of compartments for movement of each door along a path between a closed position and an open position at which a compartment associated therewith is accessible, a plurality of lock bars associated respectively with said doors, means mounting each of said bars for movement between a locking position at which an end thereof is in the path of movement of the door with which the bar is associated and a released position at which the bar end is out of the path of movement of the associated door and means including money-responsive means for selectively moving said locking bars to said released positions, said lock bar mounting means comprising means mounting each of said bars for pivotal movement around an axis extending generally transversely of the paths of movement of said doors.

19. A snack vendor including in combination a cabinet comprising a body and a plurality of doors, a drum having a plurality of groups of circumferentially arranged compartments for receiving articles of merchandise to be dispensed, means mounting said drum in said cabinet for rotation around a generally horizontal axis to present a drum upper front quadrant, said cabinet having transparent means comprising said doors disposed in front of said drum upper front quadrant, said transparent means extending from a first location in the front of the cabinet below the cabinet top and adjacent to the lower terminus of said drum upper front quadrant to a second location in the top of the cabinet spaced rearwardly of the cabinet front and adjacent to the upper terminus of said drum upper front quadrant for affording a potential customer a view of a plurality of compartments of each group and of the article next to be dispensed from each group, means for rotating said drum selectively to position said groups of compartments in register with said doors, means mounting said doors on said front in association with the respective groups of compartments for movement of each door along a path between a closed position and an open position at which a compartment associated therewith is accessible, a plurality of lock bars associated respectively with said doors, means mounting each of said bars for movement between a locking position at which an end thereof is in the path of movement of the door with which the bar is associated and a released position at which the bar end is out of the path of movement of the associated door, means including money-responsive means for selectively moving said locking bars to said released positions, a mechanical latch for holding a bar which has been moved to said released position, a reset slide, means mounting said reset slide for movement from a home position to an operative position at which it resets said latches, transport means adapted to be energized to rotate said drum around its axis, means including an externally accessible manually operable element on said cabinet adapted to be actuated to energize said transport means and means responsive to actuation of said manually operable element for moving said reset slide, said lock bar mounting means comprising means mounting each of said bars for pivotal movement around an axis extending generally transversely of the paths of movement of said doors.

20. A merchandiser as in claim 19 including means mounting said latches for pivotal movement around an axis generally perpendicular to said lock bar axis.

* * * * *

UNITED STATES PATENT AND TRADEMARK OFFICE

CERTIFICATE OF CORRECTION

PATENT NO. : 4,842,161

DATED : June 27, 1989

INVENTOR(S) : MERRILL KRAKAUER

It is certified that error appears in the above-identified patent and that said Letters Patent is hereby corrected as shown below:

Column 7, line 16 - after "movement" insert
-- between an open position and a closed position, said opening being formed in said downwardly and forwardly extending front --.

Column 8, line 42 - after "latches" insert -- , --.

Column 8, line 43 - after "rotate" insert
-- said drum around its axis, means including an externally accessible manually operable element on said cabinet adapted to be actuated to energize said transport means and a --.

Signed and Sealed this

Seventeenth Day of April, 1990

*Attest:*

*Attesting Officer*

HARRY F. MANBECK, JR.

*Commissioner of Patents and Trademarks*